US010371085B2

(12) United States Patent
Qin

(10) Patent No.: US 10,371,085 B2
(45) Date of Patent: Aug. 6, 2019

(54) CYLINDER LINER AND METHOD OF FORMING THE SAME

(71) Applicant: ZYNP International Corp., Romulus, MI (US)

(72) Inventor: Xiaocai Qin, Romulus, MI (US)

(73) Assignee: ZYNP INTERNATIONAL CORP., Romulus, MI (US)

( * ) Notice: Subject to any disclaimer, the term of this patent is extended or adjusted under 35 U.S.C. 154(b) by 152 days.

(21) Appl. No.: 15/481,501

(22) Filed: Apr. 7, 2017

(65) Prior Publication Data

US 2017/0211507 A1 Jul. 27, 2017

Related U.S. Application Data

(63) Continuation-in-part of application No. 14/608,169, filed on Jan. 28, 2015, now Pat. No. 9,850,846.

(60) Provisional application No. 61/932,583, filed on Jan. 28, 2014.

(51) Int. Cl.

| | |
|---|---|
| ***F02F 1/00*** | (2006.01) |
| ***C22C 37/10*** | (2006.01) |
| ***C22C 37/04*** | (2006.01) |

(52) U.S. Cl.

CPC ..... *F02F 1/004* (2013.01); *C22C 37/04* (2013.01); *C22C 37/10* (2013.01)

(58) Field of Classification Search

CPC ..... F02F 1/004; C22C 37/04; C22C 37/10
USPC ..... 123/668, 193.2
See application file for complete search history.

(56) References Cited

U.S. PATENT DOCUMENTS

| | | | | |
|---|---|---|---|---|
| 4,767,278 | A | 8/1988 | Enderlein, Jr. | |
| 4,869,388 | A | 9/1989 | Race | |
| 4,880,477 | A | 11/1989 | Hayes et al. | |
| 5,248,619 | A | 9/1993 | Skold et al. | |
| 5,887,646 | A | 3/1999 | Evans et al. | |
| 5,960,762 | A | 10/1999 | Imai | |
| 6,318,330 | B1 * | 11/2001 | Kestner | F02F 1/004 123/193.2 |
| 6,662,773 | B2 * | 12/2003 | Bauder | B22D 19/0009 123/193.2 |
| 6,732,698 | B1 | 5/2004 | Bedwell et al. | |
| 7,191,770 | B1 * | 3/2007 | Anderson | F02F 1/004 123/193.2 |
| 8,317,942 | B2 | 11/2012 | Pelsoeczy et al. | |
| 2003/0007882 | A1 | 1/2003 | Perrin et al. | |
| 2010/0111662 | A1 | 5/2010 | Larker | |
| 2011/0011070 | A1 | 1/2011 | Logan et al. | |
| 2011/0185993 | A1 | 8/2011 | McKimpson et al. | |

(Continued)

FOREIGN PATENT DOCUMENTS

| | | | |
|---|---|---|---|
| DE | 19629970 | C1 | 3/1998 |
| WO | 2013026124 | A1 | 2/2013 |

*Primary Examiner* — Marguerite J McMahon
(74) *Attorney, Agent, or Firm* — Michael E. Dockins; Shumaker, Loop & Kendrick, LLP

(57) ABSTRACT

A high strength cast iron material for application in heavy duty diesel engines with Pa peak cylinder pressure greater than 240 bar is disclosed, the material a ductile material austempered to get a ausferrite matrix structure with higher mechanical properties than conventional cast iron materials available by using a designed low cost alloying cast material with heat treatment. Furthermore, the cylinder liner may be formed using novel heat treatment and/or fine honing processes to improve the properties thereof.

19 Claims, 6 Drawing Sheets

Comparison among cast iron grades (general properties)

| Structure/ Property | Pearlitic GCI | Bainitic GCI | CGI | DI | Inventive Alloy (ADI) | 1050 Steel |
|---|---|---|---|---|---|---|
| Graphite Form | Flake | Flake | Compacted (Vermicular) | Nodular (Spheroidal) | Nodular (Spheroidal) | Pearlitic |
| Matrix Structure | Pearlitic | As-cast Acicular Ferrite (Bainitic) | Pearlitic | Pearlitic | Ausferrite | Ferritic + Pearlitic |
| Hardness (HBN) | 200-280 | 270-360 | 200-240 | 230-280 | 300-400 | 200-230 |
| UTS (MPa) | 200-350 | 350-450 | 450-550 | 550-700 | 650-800 | 700-800 |
| Modulus of Elasticity (GPa) | 100-120 | 120-140 | 135-155 | 140-170 | 150-180 | 200-205 |
| Density (g/cm³) | 7.0-7.2 | 7.1-7.3 | 7.0-7.2 | 7.0-7.2 | 7.0-7.2 | 7.7-7.9 |
| Thermal Conductivity (W/mK) | 40-50 | 35-45 | 35-40 | 18-25 | 16-25 | 22-28 |
| Thermal Expansion Coefficient (um/mK) | 10-12 | 10-12 | 11-12 | 11-13 | 12-14 | 12-15 |

(56) References Cited

U.S. PATENT DOCUMENTS

| | | | | |
|---|---|---|---|---|
| 2011/0274946 | A1 | 11/2011 | Severing et al. | |
| 2012/0152413 | A1 | 6/2012 | Parolini et al. | |
| 2014/0208880 | A1 | 7/2014 | Wu | |
| 2014/0318516 | A1* | 10/2014 | Edmo | C22C 37/04<br>123/668 |

* cited by examiner

Comparison among cast iron grades (general properties)

| Structure/ Property | Pearlitic GCI | Bainitic GCI | CGI | DI | Inventive Alloy (ADI) | 1050 Steel |
|---|---|---|---|---|---|---|
| Graphite Form | Flake | Flake | Compacted (Vermicular) | Nodular (Spheroidal) | Nodular (Spheroidal) | Pearlitic |
| Matrix Structure | Pearlitic | As-cast Acicular Ferrite (Bainitic) | Pearlitic | Pearlitic | Ausferrite | Ferritic + Pearlitic |
| Hardness (HBN) | 200-280 | 270-360 | 200-240 | 230-280 | 300-400 | 200-230 |
| UTS (MPa) | 200-350 | 350-450 | 450-550 | 550-700 | 650-800 | 700-800 |
| Modulus of Elasticity (GPa) | 100-120 | 120-140 | 135-155 | 140-170 | 150-180 | 200-205 |
| Density (g/cm$^3$) | 7.0-7.2 | 7.1-7.3 | 7.0-7.2 | 7.0-7.2 | 7.0-7.2 | 7.7-7.9 |
| Thermal Conductivity (W/mK) | 40-50 | 35-45 | 35-40 | 18-25 | 16-25 | 22-28 |
| Thermal Expansion Coefficient (um/mK) | 10-12 | 10-12 | 11-12 | 11-13 | 12-15 | 12-15 |

Fig. 1

Typical microstructure
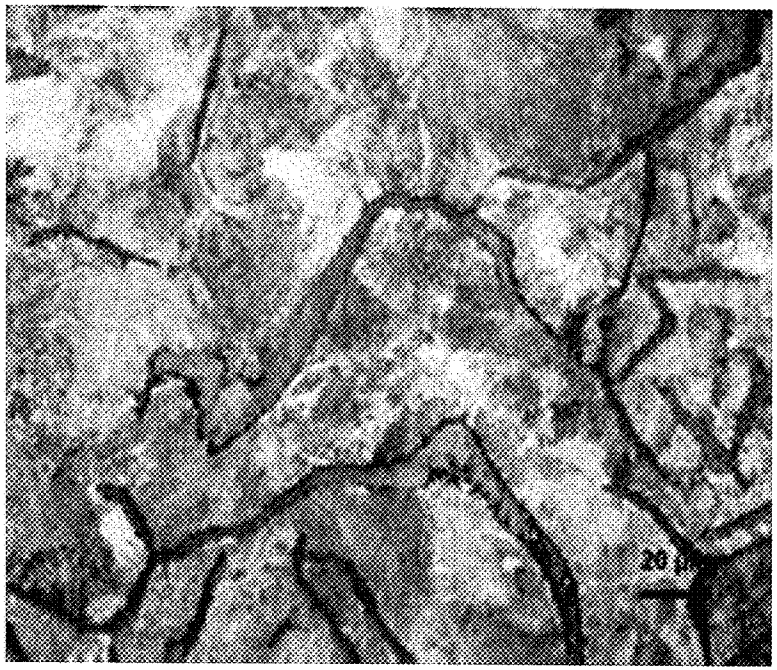
Pearlitic matrix with type- A graphite
2% Nital, 500x
ADI
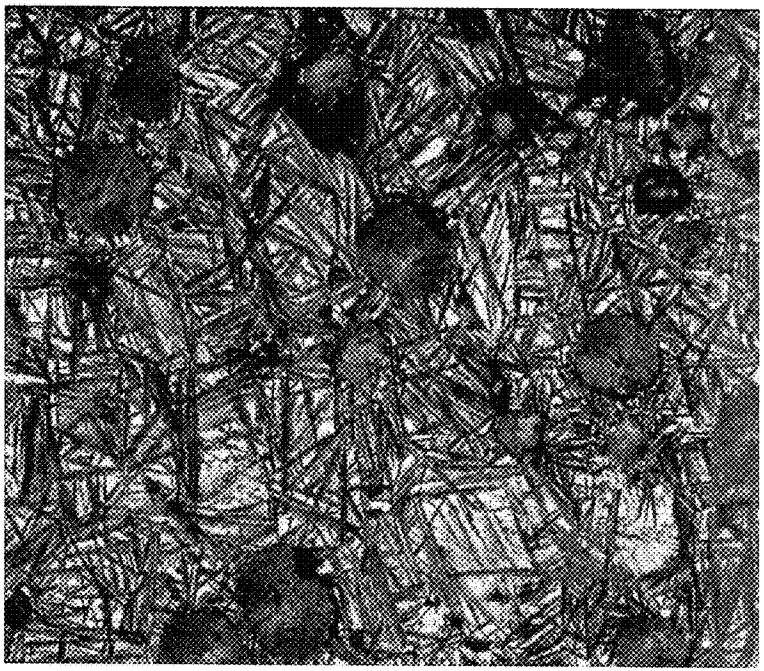
Austempered at 620° F (320 °C) for 60 min
Acicular ausferrite matrix, 2% Nital, 500x
Fig. 2

Comparison of chemical composition

| Element | Composition (wt%) | | | |
|---|---|---|---|---|
| | Gray Iron | Gray Iron | Ductile iron | Inventive Alloy |
| | Pearlitic | Bainitic | Pearlitic | (ADI) |
| Carbon | 3.02 | 2.83 | 3.62 | 3.62 |
| Silicon | 1.85 | 2.12 | 2.36 | 2.36 |
| Manganese | 0.85 | 0.46 | 0.49 | 0.49 |
| Phosphorus | 0.22 | 0.047 | 0.027 | 0.027 |
| Sulfur | 0.05 | 0.036 | 0.02 | 0.02 |
| Copper | - | 0.36 | 0.87 | 0.87 |
| Nickel | 0.85 | 1.24 | 0.34 | 0.34 |
| Chromium | 0.24 | - | - | - |
| Molybdenum | 0.35 | 0.82 | 0.14 | 0.14 |

Fig. 3

CYLINDER LINER AND METHOD OF FORMING THE SAME

CROSS-REFERENCE TO RELATED APPLICATIONS

This application is a continuation-in-part of U.S. patent application Ser. No. 14/608,169 filed on Jan. 28, 2015 which claims the benefit of priority of U.S. Provisional Pat. Appl. Ser. No. 61/932,583 filed on Jan. 28, 2014, the entire disclosure of each of which is incorporated herein by reference.

FIELD

The present technology relates to cylinder liners and, more particularly, to a cylinder liner for internal diesel combustion engines and methods for processing of the same.

INTRODUCTION

This section provides background information related to the present disclosure which is not necessarily prior art.

Cylinder liners for internal combustion engines consist predominantly of gray cast iron alloys with lamellar graphitization embedded in pearlitic microstructure. In particular after the introduction of new technologies as exhaust gas recirculation (EGR), it was observed an increase on the demand of diesel engines. This growth is surrounded by requirements such as: less fuel consumption, emissions reduction, and larger power output and torque. Improved performance, as operation efficiency and engine power density are being achieved by the rise of combustion chamber pressures, particularly for diesel engines. For diesel passenger cars, peak firing pressures in excess of 160 bar or 180 bar can be expected. Heavy-duty truck engines are expected to achieve peak cylinder pressures (PCP) up to 240 bar.

It would be desirable to develop a cylinder liner formed from an alloy and/or made from a more efficient process that increases the materials and reliability thereof.

SUMMARY

The present technology includes systems, processes, articles of manufacture, and compositions that relate to cylinder liners.

In some embodiments, a cylinder liner is provided that includes a first portion and a second portion. The first portion include a first graphite morphology in a first matrix including iron. The second portion includes a second graphite morphology in a second matrix including iron. The first graphite morphology is different from the second graphite morphology. The first matrix and the second matrix can be substantially the same and the first matrix and the second matrix can be different. The first portion can include an inner surface of the cylinder liner and the second portion can include an outer surface of the cylinder liner.

In various embodiments, a cylinder liner is provided that includes an inner surface including compact graphite iron and an outer surface including austempered ductile iron. The compact graphite iron can include graphite in the form of vermicular structures or flakes. The austempered ductile iron can include graphite in the form of nodular or spheroidal shapes.

In certain embodiments, a cylinder liner is provided that includes a inner portion and an outer portion. The inner portion includes a first graphite morphology in a first matrix including iron. The outer portion includes a second graphite morphology in a second matrix including iron. The outer portion has an ultimate tensile strength that is at least 200 MPa greater than an ultimate tensile strength of the inner portion.

Accordingly, as used on an inner portion of the cylinder liner, compact graphite iron can provide improved sliding properties and wear resistance against one or more piston rings and a piston due in part to the particular graphite shape. Compact graphite iron can also provide improved machinability to optimize proper honing of the interior surface of the cylinder liner. Austempered ductile iron, as used on an outer portion of the cylinder liner, can provide improved tensile strength resistance due to the spheroidal graphite shapes that minimize crack propagation. Moreover, austempered ductile iron can provide a greater resistance to cavitation and can reduce vibration.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The above, as well as other advantages of the present technology, will become readily apparent to those skilled in the art from the following detailed description of a preferred embodiment when considered in the light of the accompanying drawings in which:

FIG. 1 is a tabular comparison of the general properties among prior art grades of cast iron, including ADI, the material according to an embodiment of the present technology;

FIG. 2 is a magnified photograph of a prior art material as compared to that of the ADI material according to the embodiment of the present technology;

FIG. 3 is a tabular comparison of the chemical composition of prior art materials as compared to the ADI material according to the embodiment of the present technology;

DETAILED DESCRIPTION

Figure 5:
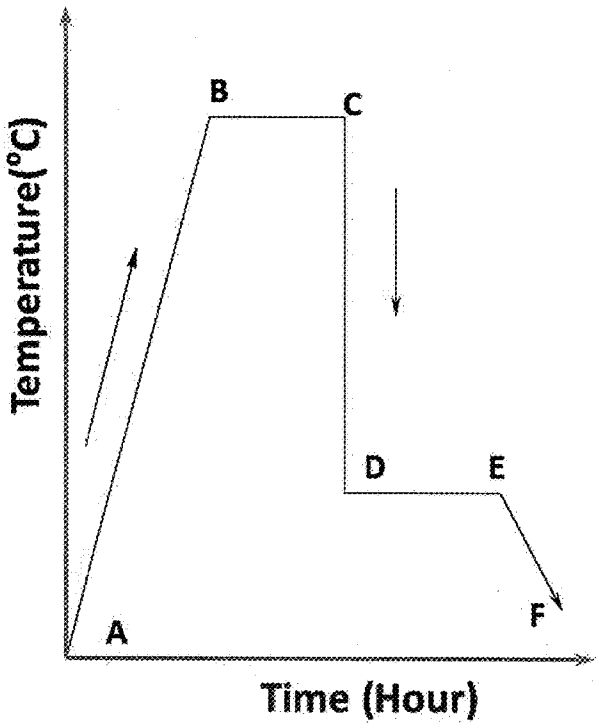
FIG. 5 is a graph of temperature versus time for a heat treatment process to form the ADI material according to embodiment of the present technology.

The following detailed description and appended drawings describe and illustrate various exemplary embodiments of the present technology. The description and drawings serve to enable one skilled in the art to make and use the present technology, and are not intended to limit the scope of the present technology in any manner. In respect of the methods disclosed, the steps presented are exemplary in nature, and thus, the order of the steps is not necessary or critical. It is further understood that the methods disclosed herein may be employed together or separately to form a cylinder liner using the novel materials and formulations described herein.

Except where otherwise expressly indicated, all numerical quantities in this description are to be understood as modified by the word "about" and all geometric and spatial descriptors are to be understood as modified by the word "substantially" in describing the broadest scope of the technology. All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls. Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, all compositional percentages are by weight of the total composition, unless otherwise specified. Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

According to an embodiment of the present technology, a cylinder liner is formed from a novel material using a novel formation process. The spheroidal (ductile iron) graphite morphology particles embedded in an austempered structure appear to have the potential to improve material capacity with regard important physical properties such as tensile strength, stiffness, and fatigue strength that is improved over conventional gray cast iron material. Consequently the novel cylinder liner may have a reduced wall thickness as compared to conventionally formed cylinder liners with an increasing power density for engines the novel cylinder liner is used therein.

The novel cylinder liner incorporates avoids the formation of graphite flakes and graphite in the form of veins knowing that an increase in an amount of magnesium fosters the reduction thereof. By increasing magnesium, nodular graphite particles are formed. This graphite morphology is elongated and randomly oriented as in gray iron; however the nodular graphite particles have rounded edges to inhibit crack initiation and growth and is the source of the improved mechanical properties in the novel cylinder liner, as compared to gray iron. Magnesium may be present in an amount of about 0.005% to about 0.06% by weight to get the desired nodularity. More than 0.06% by weight magnesium may be used, as desired. As the nodularity increases, the strength and stiffness of the novel cylinder liner also increases.

This novel cylinder liner includes a microstructure made of ausferrite and nodular graphite. Ausferrite is a combination of high carbon enriched metastable austenite plus acicular ferrite. This unique microstructure imparts the cylinder liner (austempered ductile iron) ADI with a yield strength up to 730 MPa, UTS 850-900 MPa, 5-10% elongation, 290-340 HB, plus improved fatigue, wear and cavitation resistance. The microstructure includes graphite—Nodular (Form I)>80%, nodule size—class 6-7 (20-30 um) and matrix-acicular ausferrite.

FIG. 1 shows a tabular comparison of the general properties among the various grades of cast iron, including the novel ADI, the material used to form the cylinder liner according to the present technology. FIG. 2 shows a typical microstructure of a prior art material, a material having a pearlitic matrix, at 500× magnification in a side-by-side comparison of the ADI material at 500× magnification. FIG. 3 is a tabular comparison of the chemical composition of known alloys as compared to the material according to an embodiment of the present technology. The alloy (ADI) is formed from the following materials in wt %: C—between about 3.55% and about 3.65% and preferably about 3.62%, Si—between about 2.30% and about 2.40% and preferably about 2.36%, Mn—between about 0.45% and about 0.50% and preferably about 0.49%, P—between about 0.020% and about 0.030% and preferably about 0.27%, S—between about 0.15% and about 0.25% and preferably about 0.20%, Cu—between about 0.80% and about 0.90% and preferably about 0.87%, Ni—between about 0.30% and about 0.40% and preferably about 0.34%, Mo—between about 0.10% and about 0.20% and preferably about 0.14%, Mg—between about 0.005% and about 0.06%, and substantially free from Cr.

According to another embodiment of the present technology, a cylinder liner is formed having two portions having different microstructures. The microstructures can include different graphite morphologies within a matrix including iron. The different graphite morphologies of the different microstructures can be within the same matrix, within substantially similar matrixes, or within different matrixes. For example, the cylinder liner can have an inner portion including a first graphite morphology and an outer portion with a second graphite morphology. The cylinder liner can also have an inner surface with the first graphite morphology and an outer surface with the second graphite morphology. The first graphite morphology can include compact graphite iron (CGI) and the second graphite morphology can include austempered ductile iron (ADI). The CGI can have a compact graphite shape, which can present various vermicular configurations, flakes, or veins within a matrix including iron, and can include some spheroidal graphite portions, as well. The ADI, also referred to as an ausferrite matrix, can include nodular graphite configurations within a matrix including iron.

Figure 6:
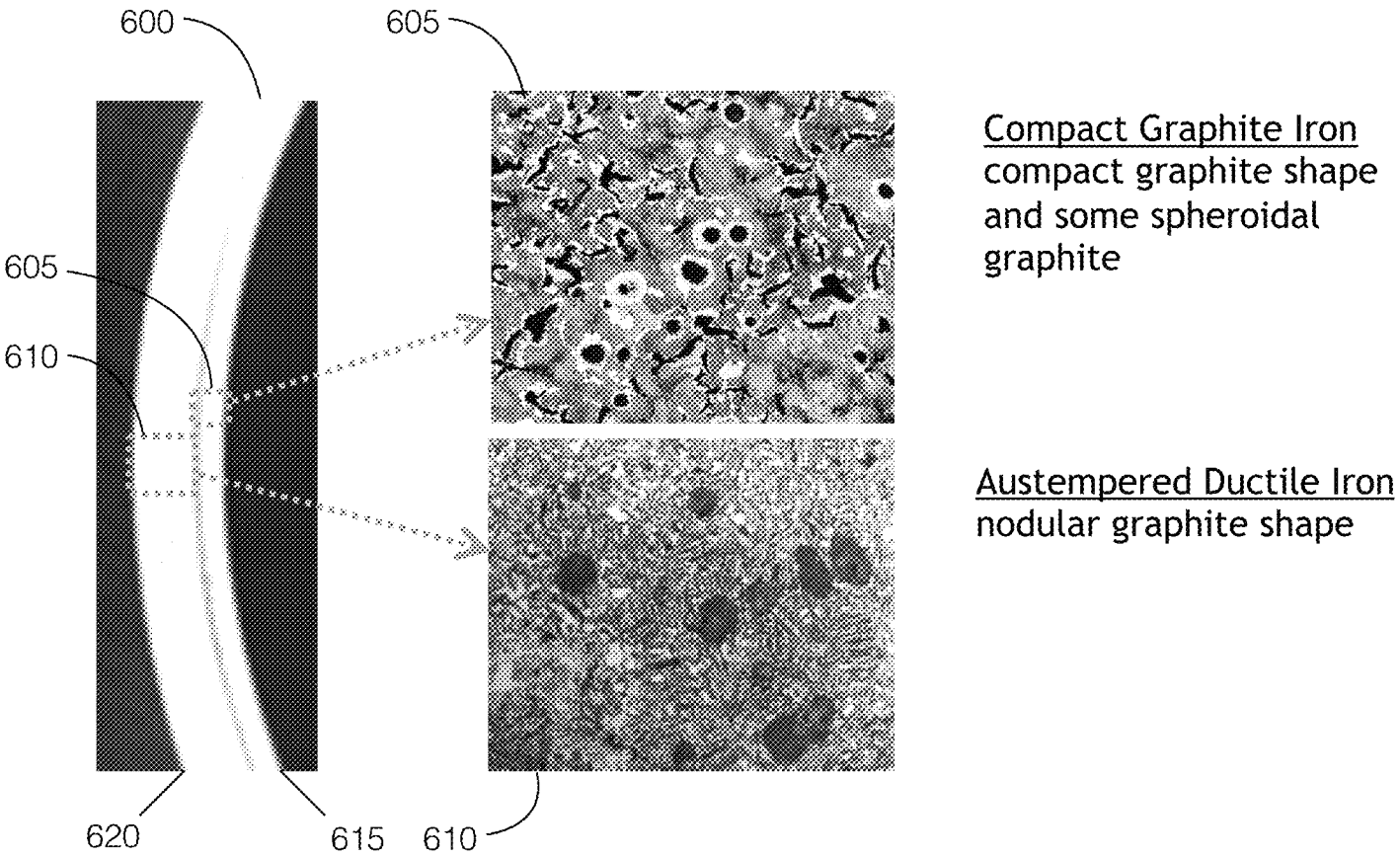
FIG. 6 is a cross-sectional view of a cylinder liner according to another embodiment of the present technology, including magnified photographs of different portions of the cylinder liner showing different graphite morphologies.

An example of the cylinder liner formed having two portions having different microstructures is shown in FIG. 6. The cylinder liner 600 is shown in partial cross-section in the left panel of FIG. 6, where the inner portion 605 has the first graphite morphology including CGI and the outer portion 610 has the second graphite morphology including ADI. The inner portion 605 can include an inner surface 615 of the cylinder liner 600 and/or can include an inner depth of the cylinder liner 600 from the inner surface 615 as indicated by the box at 605. Likewise, the outer portion 610 can include an outer surface 620 of the cylinder liner 600 and/or can include an outer depth of the cylinder liner 600 from the outer surface 620 as indicated by the box at 610. The inner portion 605 and the outer portion 610 shown in FIG. 6 are simply representative and various embodiments can include where the inner portion 605 comprises a majority of the cylinder liner 600 in comparison with the outer portion 610, and vice versa. In certain embodiments, the inner portion 605 and the outer portion 610 can comprise substantially equal portions of the cylinder liner 600. The two right panels of FIG. 6 show enlarged views of the inner portion 605 and the outer portion 610 to illustrate the first graphite morphology including CGI and the second graphite morphology including ADI, respectively.

Figure 7B:
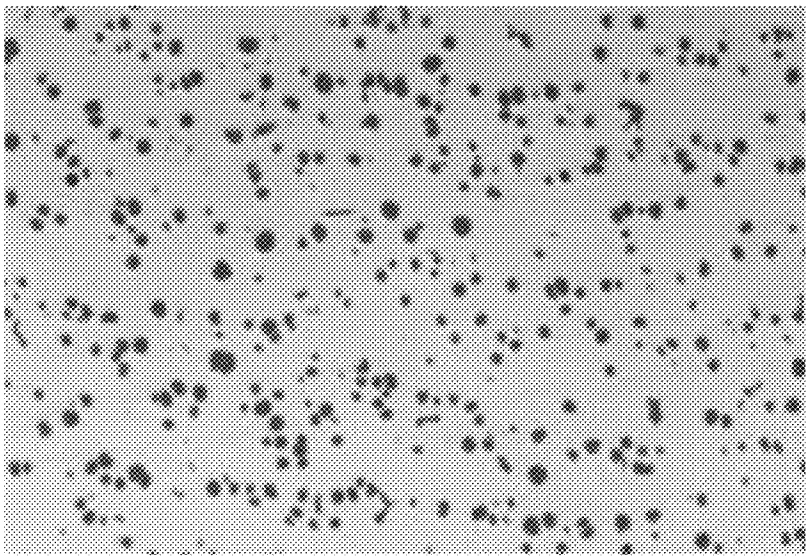
FIG. 7A is a magnified photograph of compact graphite iron in a matrix that includes iron and FIG. 7B is a magnified photograph of austempered ductile iron in a matrix that includes iron.
Figure 7A:
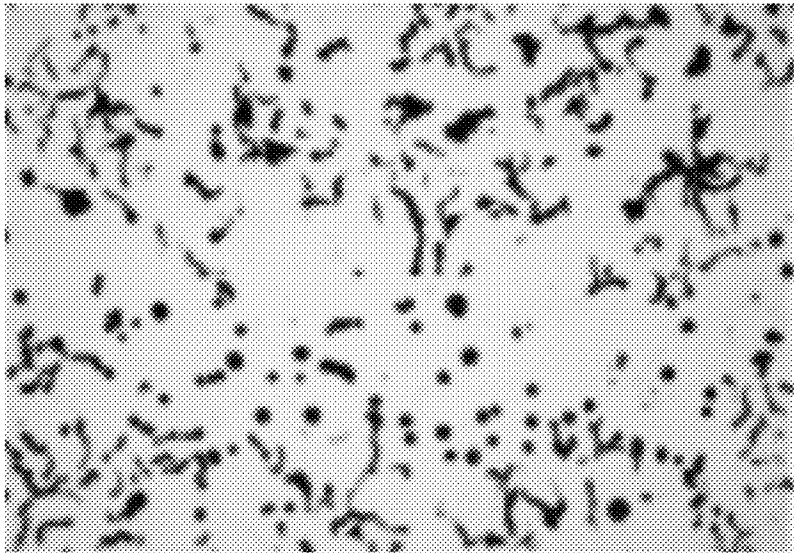

As the name implies, the CGI includes compact graphite iron in a matrix that includes iron. The matrix can also include the other metals and alloys, including the various materials, combinations thereof, and weight percentages described herein. The compact graphite can take the form of vermicular structures or flakes dispersed throughout the matrix, ranging from short structures to longer vein-like structures. Some spheroidal graphite structures can also be present in the CGI. As used on the interior portion of the cylinder liner, the CGI can provide improved sliding properties and wear resistance against one or more piston rings and a piston due in part to the particular graphite shape. The CGI can also provide improved machinability to optimize proper honing of the interior surface of the cylinder liner. Mechanical properties of the CGI can include an ultimate tensile strength (UTS) of 650 MPa. A cross-sectional example of compact graphite iron is shown in FIG. 7A.

The ADI includes an ausferrite matrix with nodular and spheroidal graphite shapes. The ausferrite matrix can also include the other metals and alloys, including the various materials, combinations thereof, and weight percentages described herein. The ADI can provide improved tensile strength resistance due to the spheroidal graphite shapes that minimize crack propagation. Moreover, the ADI can provide a greater resistance to cavitation than CGI and can have a higher UTS (e.g., 900 MPa), which can reduce vibration. In certain embodiments, the ADI can have a UTS that is >100 MPa, >200 MPa, or >250 MPa than CGI. The use of ADI can further improve certain embodiments of cylinder liners, including cylinder liners with a counter bore design. A cross-sectional example of the ausferrite matrix with nodular graphite is shown in FIG. 7B.

Cavitation occurrence can be a problem in heavy duty diesel engines due to peak cylinder pressures that can be above 240 MPa, along with the use of steel pistons. The impact of steel pistons against the cylinder liner can cause vibration that can create bubbles in the external surface of the cylinder liner that is in contact with an engine coolant, where eruption of the bubbles can lead to cavitation in the cylinder liner. The cylinder liner constructed in accordance with the present technology can therefore combine a high UTS (e.g., 850-900 MPa) and hardness (e.g., 290-340 HB) from ADI in the outer portion, which improves cavitation resistance due to the high UTS and discontinuous graphite, with CGI in the inner portion, which provides well-distributed vermicular graphite or flakes from compact graphite iron that has improved sliding properties, preventing wear and scuffing from other components (e.g., piston rings) in contact with the cylinder liner.

Figure 4:
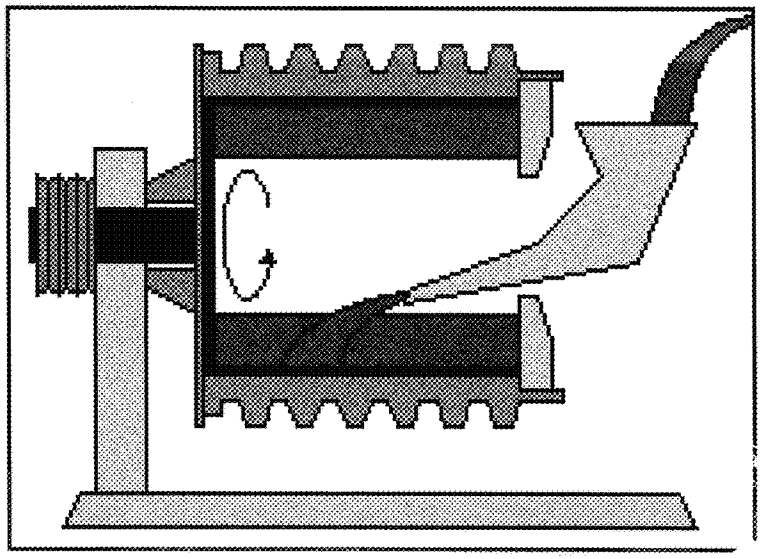
FIG. 4 is a drawing of a centrifugal casting apparatus used in a method according to an embodiment of the present technology to form a cylinder liner using the material described herein and/or shown in FIGS. 1-3.

According to yet another embodiment of the present technology, a process for forming the ADI cylinder liner as described hereinabove using a device shown in FIG. 4 is as follows:

1. A mold is set up and rotated along a horizontal (1000-1700 rpm) axis.
2. The mold is coated with a refractory coating.
3. While rotating, molten metal having a desired composition is formed.
4. The metal that is poured in will then distribute itself over the rotating wall.
5. During cooling lower density impurities will tend to rise towards the center of rotation.
6. After the part has solidified, it is removed.

The process of forming the ADI cylinder liner further undergoes a heat treatment as shown in FIG. 5. FIG. 5 illustrates a graph of temperature versus time for the heat treatment of the novel cylinder liner formed from the ADI materials disclosed herein according to another embodiment of the present technology. The formed cylinder liner is heated to a temperature up to from about 850° C. to about 900° C. over a desired period of time (line A-B). The ductile iron is austenized at the temperature from about 850° C. to about 900° C. for a desired amount of time (line B-C). During the austenizing step, the temperature may be kept substantially constant or may vary within ±15° C., as desired. The length of time for the austenizing step will vary based on the thickness and size of the cylinder liner. This time period may be calculated by one of ordinary skill in the art. The austenized ductile iron is then cooled via a quenching step in a bath such as a salt bath (line C-D). The cylinder liner is cooled in the bath to a temperature from about 375° C. to about 400° C. whereby the material forming the cylinder liner is austempered (line D-E). Metallurgical reactions occurring during the austempering step:

$$\gamma \rightarrow \alpha + \gamma_{HC}$$

$$\gamma_{HC} \rightarrow \alpha + \varepsilon$$

After the austempering step, the austempered material is further cooled to ambient temperature to obtain the ADI material described herein (line E-F). Prior to the heat treatment step or after the heat treatment step, as desired, the cylinder liner may be honed and otherwise machined. One process for honing and the resultant surface specifications of the cylinder liner that may be utilized for the ADI alloy described herein is disclosed in commonly-owned U.S. Provisional Patent Application Ser. No. 61/932,583 filed on Jan. 28, 2014 and a commonly-owned U.S. Non-Provisional patent application Ser. No. 14/608,164 filed on Jan. 28, 2015 that claims the benefit of the earlier filing date of the '583 application, each of which is incorporated herein by reference in their entirety.

The object is appropriate for the present technology at the basis to also find a cast iron alloy for high demand engines (PCP greater than about 240 bar) as a result of mechanical properties improvements. The benefits of the present technology over known alloys include:

Wall thickness ratio 3:2 (higher output for existing engine block or new downsized engines);

Higher cavitation-erosion resistance (due to high modulus of elasticity);

Higher selective corrosion resistance (discontinued graphite);

Best solution for scraper ring design (due to high mechanical properties);

Thermal conductivity ratio 2:1 (possible slight increasing of temperature for a better engine thermal efficiency);

Reduction in weight of machined cylinder liner; and

Reduction in overall weight of the finished engine.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A cylinder liner comprising:

a first portion including a first graphite morphology in a first matrix including iron; and a second portion including a second graphite morphology in a second matrix including iron, the first graphite morphology different from the second graphite morphology, the second portion including austempered ductile iron.

2. The cylinder liner of claim 1, wherein the first matrix and the second matrix are substantially the same.

3. The cylinder liner of claim 1, wherein the first matrix and the second matrix are different.

4. The cylinder liner of claim 1, wherein the first portion includes an inner surface of the cylinder liner.

5. The cylinder liner of claim 1, wherein the second portion includes an outer surface of the cylinder liner.

6. The cylinder liner of claim 1, wherein the first portion includes compact graphite iron.

7. The cylinder liner of claim 1, wherein one of the first portion and the second portion includes between about 3.55 wt % and about 3.65 wt % carbon.

8. The cylinder liner of claim 1, wherein one of the first portion and the second portion includes between about 0.005 wt % and about 0.06 wt % magnesium.

9. The cylinder liner of claim 1, wherein one of the first portion and the second portion includes at least four members of a group consisting of: (a) between about 3.55 wt % and about 3.65 wt % C; (b) between about 2.30 wt % and about 2.40 wt % silicon; (c) between about 0.45 wt % and about 0.50 wt % manganese; (d) between about 0.020 wt % and about 0.030 wt % phosphorous; (e) between about 0.15 wt % and about 0.25 wt % sulfur; (f) between about 0.80 wt % and about 0.90 wt % copper; (g) between about 0.30 wt % and about 0.40 wt % nickel; (h) between about 0.10 wt % and about 0.20 wt % molybdenum; (i) between about 0.005 wt % and about 0.06 wt % magnesium; and (j) substantially free from chromium.

10. The cylinder liner of claim 9, wherein one of the first portion and the second portion includes each of (a), (b), (c), (d), (e), (f), (g), (h), (i), and (j).

11. The cylinder liner of claim 1, wherein an inner surface of the cylinder liner is honed.

12. A cylinder liner comprising:

an inner surface including compact graphite iron; and an outer surface including austempered ductile iron.

13. The cylinder liner of claim 12, wherein the inner surface includes a first matrix including iron and the outer surface includes a second matrix including iron.

14. The cylinder liner of claim 12, wherein the first matrix and the second matrix are substantially the same.

15. The cylinder liner of claim 12, wherein the first matrix and the second matrix are different.

16. The cylinder liner of claim 12, wherein the compact graphite iron includes graphite in the form of vermicular structures or flakes.

17. The cylinder liner of claim 12, wherein the austempered ductile iron includes graphite in the form of nodular or spheroidal shapes.

18. The cylinder liner of claim 12, wherein one of the first portion and the second portion includes between about 3.55 wt % and about 3.65 wt % carbon and between about 0.005 wt % and about 0.06 wt % magnesium.

19. A cylinder liner comprising:

an inner portion including a first graphite morphology in a first matrix including iron; and an outer portion including a second graphite morphology in a second matrix including iron, the outer portion having an ultimate tensile strength that is at least 200 MPa greater than an ultimate tensile strength of the inner portion, the second portion including austempered ductile iron.

* * * * *